US006218092B1

(12) United States Patent
Tsukada

(10) Patent No.: US 6,218,092 B1
(45) Date of Patent: Apr. 17, 2001

(54) PROCESSING METHOD OF SILVER HALIDE LIGHT SENSITIVE PHOTOGRAPHIC MATERIAL

(75) Inventor: Kazuya Tsukada, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/532,908

(22) Filed: Mar. 22, 2000

(30) Foreign Application Priority Data

Mar. 23, 1999 (JP) ..... 11-077018

(51) Int. Cl.[7] ..... G03C 5/29
(52) U.S. Cl. ..... 430/446; 430/440; 430/963
(58) Field of Search ..... 430/440, 446, 430/963

(56) References Cited

U.S. PATENT DOCUMENTS 5,591,561 * 1/1997 Arai et al. ..... 430/264
5,869,225 * 2/1999 Yamaya ..... 430/440
5,948,603 * 9/1999 Uchihiro et al. ..... 430/446
5,962,201 * 10/1999 Ishikawa et al. ..... 430/446
5,962,202 * 10/1999 Sampei ..... 430/446

* cited by examiner

*Primary Examiner*—Hoa Van Le
(74) *Attorney, Agent, or Firm*—Cantor Colburn LLP

(57) ABSTRACT

A processing method of silver halide light sensitive photographic materials by the use of an automatic processor is disclosed, comprising the steps of developing, fixing and washing, in which a developing bath of the processor comprises a processing tank and a temperature-controlling tank and a ratio by volume of the temperature-controlling tank to the processing tank being 0.4 to 1.0; the developing solution containing a reducton represented by the following formula (1); and the photographic material being processed according to the following requirement [1]:

formula (1)

requirement [1]

$L^{0.75} \times T = 50$ to 150.

20 Claims, 1 Drawing Sheet

PROCESSING METHOD OF SILVER HALIDE LIGHT SENSITIVE PHOTOGRAPHIC MATERIAL

FIELD OF THE INVENTION

The present invention relates to a method for processing silver halide light sensitive photographic materials and in particular to a processing method whereby silver halide light sensitive photographic materials can be stably processed even at a low replenishing rate.

BACKGROUND OF THE INVENTION

Recently, concern about ecology has increased, ocean disposal of processing chemicals used for silver halide photographic materials is prohibited and there is increasing pressure to release the amount of processing chemicals used in medical care.

To compensate for consumption of developer components during development, processing chemicals are replenished at the rate to keep constant the amounts of the processing chemicals supplied to the silver halide photographic material. To reduce the amount of processing chemicals being used, replenishment is desired to be done at a low replenishing rate. However, when processed at a low replenishing rate, the residence time of the developer solution in a developing tank increases, producing problems that the developer is much more subjected to oxidation and hence developing activity thereof is lowered.

As an automatic processor systems used for processing silver halide black-and-white photographic materials have been employed plural systems having a variety of functions and specifications corresponding to various uses and facilities, including small and large processors, standard processes and rapid processes, low replenishing processes and ultra-low replenishing processes.

Specifically, small-sized processors are popular among small-scaled facilities mainly for medical practitioners because of their space-saving, light weight and simplicity.

The number of clients per day in a medical practitioner facility is limited, in which films including X-ray photographs, MRI images outputted by a laser imager and ultrasonic images photographed by a G-camera are processed using an automatic processor, even though the processing amount thereof is small. In cases when the processing amount is relatively small, replacement per unit time of the developer solution used in the processor is lowered to prolong the residence time of the developer solution, increasing influences of oxidation exhaustion and resulting in reduced developing activity. Accordingly, an important factor is how to maintain running process stable over a long period of time in the such small-sized processor systems.

As a feature of the small processor, the space for processing tanks is limited so that the processing path length is short and the transport rack has a simple structure (having fewer rollers), making it difficult to achieve the levels of developability or fixability of medium- or large-sized processors. In light of the characteristics of the small processors with respect to the structure and the usage thereof, improvements in process stability and development uniformity are strongly sought.

To overcome these problems were disclosed various means, such as the open top area of the developing tank being extremely reduced, the pH of the developer solution being lowered to lessen development activity to enhance development stability, an antioxidant is added, or the flow velocity of the developer solution being more precisely controlled. However, there were problems that the developer solution contained dihydroxybenzene developing agents and even in cases of the developer containing reductons, its development stability was insufficient. Further, there were marked problems in fluctuations of temperature and variation with respect to density or silver amount of the photographic material being processed.

SUMMARY OF THE INVENTION

Accordingly, it is an object of the present invention to provide a photographic developer and a method for processing silver halide light sensitive photographic materials, in which no lowering of activity of a developer solution, caused by aerial oxidation occurs even when replenished at a reduced rate.

Further, it is an object of the invention to provide a method for processing silver halide light sensitive photographic materials, thereby superior development stability over a long period of time, which has been increasingly demanded of small-sized processors, reducing development unevenness and reducing variation caused by fluctuations in the processing condition.

Furthermore, it is an object of the invention to provide a processing method in which sludge adhesion and crystal formation often occurred when processed at a low replenishing rate and the period between maintenance being six months or more.

The above-described objects of the invention can be accomplished by the following constitution:

1. A method for processing a silver halide light sensitive photographic material by the use of an automatic processor, the method comprising the steps of:
   developing an exposed photographic material with a developing solution,
   fixing the developed photographic material with a fixing solution, and
   washing the photographic material, wherein a developing bath of the processor comprises a processing tank and a temperature-controlling tank and a ratio by volume of the temperature-controlling tank to the processing tank being 0.4 to 1.0; said developing solution containing a reducton represented by the following formula (1); and the photographic material being processed according to the following requirement (1):

formula (1)

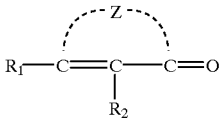

wherein $R_1$ and $R_2$ are each —OM, a mercapto group, an amino group, an acylamino group, an alkylsulfonylamino group, an arylsulfonylamino group, an alkoxycarbonyl group or an alkylthio group, in which M is a hydrogen atom or an alkali metal; and Z is an atomic group necessary to complete a 5- or 6-membered ring;

$$L^{0.75} \times T = 50 \text{ to } 150 \qquad \text{requirement [1]}$$

wherein L is a transport length in the processor within a range of 0.5 to 0.8 m; and T is a total processing time of the processor;

2. A method for processing a silver halide light sensitive photographic material by the use of an automatic processor, the method comprising the steps of:

developing an exposed photographic material with a developing solution, fixing the developed photographic material with a fixing solution, and washing the photographic material, wherein the processor comprises a developing transport rack, a fixing transport rack and a washing transport rack and each of the racks having a cylindrical transport roller having propylene exhibiting a contact angle with distilled water of 90 to 130°;

3. A method for processing a silver halide light sensitive photographic material by the use of an automatic processor, the method comprising the steps of:

developing an exposed photographic material with a developing solution, fixing the developed photographic material with a fixing solution, and washing the photographic material, wherein the photographic material has a silver coverage of 1.1 to 1.7 g per $m^2$ of one side of the photographic material, and the average flow velocity of the developing solution at the time of developing being 70 to 120 mm/sec;

4. A developer used for a silver halide photographic material, wherein the developer contains a compound represented by the following formula (2):

formula (2)

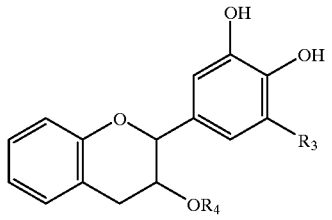

wherein $R_3$ is a hydrogen atom or a hydroxy group; $R_4$ is a hydrogen atom or a group represented by the following formula (3):

formula (3)

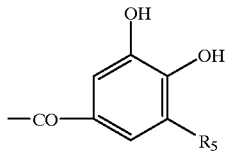

wherein $R_5$ is a hydrogen atom or a hydroxy group;

5. A developer used for a silver halide light sensitive photographic material, containing a reductone represented by formula (1) and a compound represented by formula (2);

6. The developer described in 4. or 5. above, wherein the developer is a solid composition;

7. The developer described in 4. or 5. above, wherein the developer is a concentrated solution;

8. The developer described in any of 5. to 7. above, wherein the developer is comprised of a single composition;

9. A method for processing a silver halide light sensitive photographic material, the method comprising developing an exposed photographic material using the developer described in any of 5. to 8. above;

10. The processing method described in 4. above, wherein the pH of the developing solution at the start of developing is 0.1 to 0.3 lower than that of a developer replenishing solution;

13. The processing method described in 1. above, wherein the developing solution is substantially free of a dihydroxybenzene; and 14. The processing method described in 1. above, wherein the developing solution is replenished at a rate of 70 to 150 ml/$m^2$.

DETAILED DESCRIPTION OF THE INVENTION

Figure 1:
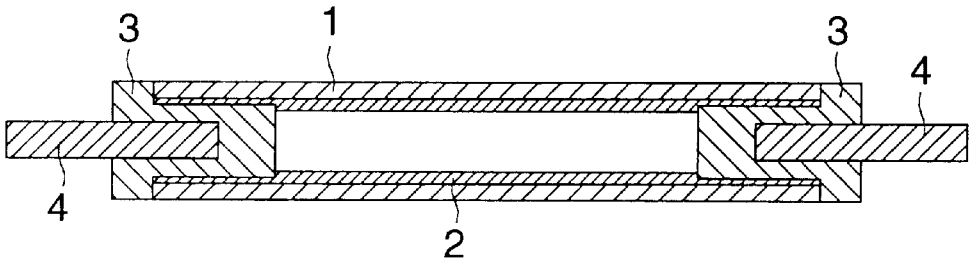
FIG. 1 illustrates a sectional view of a roller used in an automatic processor used in the invention.

In the present invention, the transport length, L, is the length of transport of the total steps of from the first step to the final step in the processor. The total processing time, T, is the period of time between the time when the top of the photographic material enters the processor and the time when the top of the photographic material exits the processor.

Reductones used in the invention, represented by formula (1) will be further described. In the formula, R, and $R_2$ are each —OM (in which M is a hydrogen atom or an alkali metal), a mercapto group, an amino group (including one substituted by an alkyl group having 1 to 10 carbon atoms, such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., methoxycarbonyl) or an alkylthio group (e.g., methylthio, ethylthio). Preferred examples of $R_1$ and $R_2$ include —OM group, an amino group, an alkylsulfonylamino group, and an arylsulfonylamino group.

Z is preferably comprised of a carbon atom, oxygen atom or nitrogen atom, and forms a 5- or 6-membered ring, together with vinyl carbons substituted by $R_1$ and $R_2$ and a carbonyl carbon, and preferably a reducton ring. Exemplary examples of Z include —O—, —C($R_{10}$) ($R_{11}$)—, —C($R_{12}$)=, —C(=O)—, —N($R_{13}$)—, —N= and their combination, in which $R_{10}$, $R_{11}$, $R_{12}$ and $R_{13}$ are each a hydrogen atom, an alkyl group having 1 to 10 carbon atoms (which may be substituted by a substituent such as hydroxy, carboxy or sulfo group), an aryl group having 6 to 15 carbon atoms (which may be substituted by a substituent such as an alkyl group, a halogen atom, hydroxy, carboxy or sulfo group), hydroxy group, or carboxy group. The 5- or 6-membered ring may form a saturated or unsaturated condensed ring. Examples of the 5- or 6-membered ring include dihydrofuran ring, dihydropyrone ring, pyranone ring, cyclopentenone ring, cyclohexenone ring, pyrrolinone ring, pyrazolinone ring, pyridone ring, azacyclohexenone ring and uracil ring. The 5- or 6-membered ring is preferably dihydrofuran ring, cyclopentenone ring, cyclohexenone ring, pyrazolinone ring, azacyclohexenone ring and uracil ring. The compound represented by formula [1] may be present in the form of an ion.

Exemplary examples of the reductions represented by formula (1) are shown below, but are not limited to these.

1-1
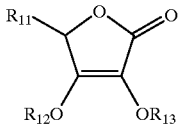
1-2
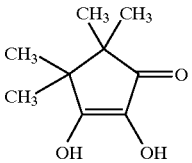
1-3
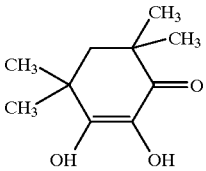
1-4
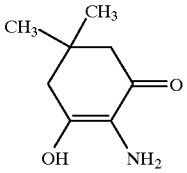
1-5
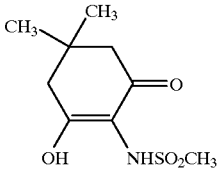
1-6
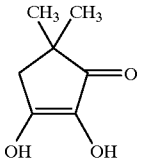
1-7
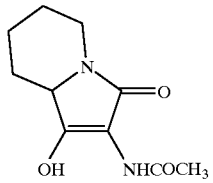
1-8
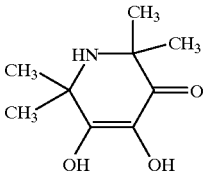
-continued
1-9
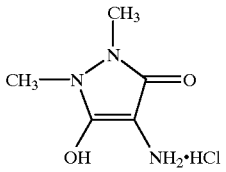
1-10
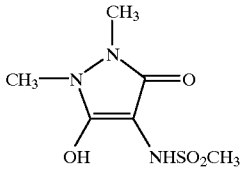
1-11
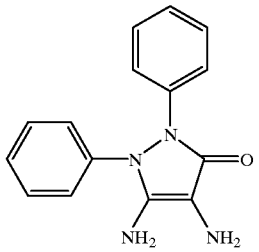
1-12
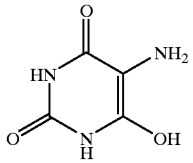
1-13
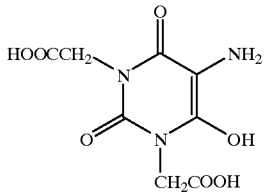
1-14
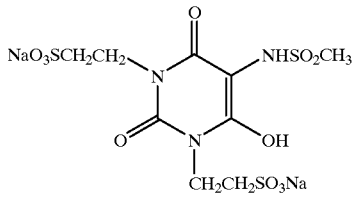
1-15
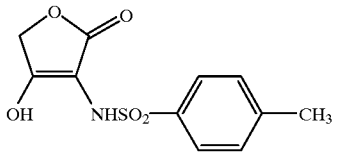
1-16
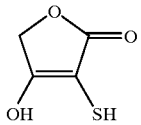

-continued 1-17

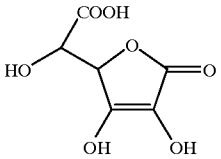

1-18

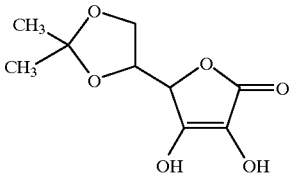

1-19

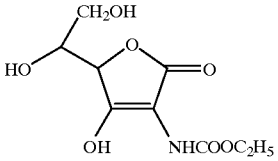

1-20

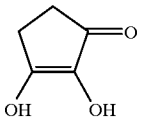

1-21

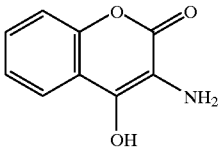

1-22

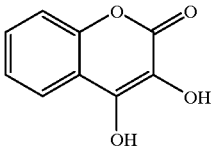

In cases where the reducton represented by formula (1) is an acid, it may be in the form of a free acid or its salt. Among the compounds described above are preferred L-ascorbic acid, erythorbic acid represented by formula 1-1 described above, or their salts.

Compounds (reductons) will be further described. The preferred reductons used in developers or developing solutions used in the invention and represented by formula (1-1) include an ene-diol type, enaminol type, ene-diamine type, thiol-enol type and ethanethiol type. Thus, the compounds are preferably represented by the following formula (1-1):

formula (1-1)

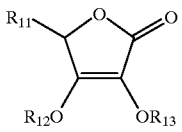

wherein $R_{12}$ and $R_{13}$ are each a hydrogen atom or an alkali metal; and $R_{11}$ is

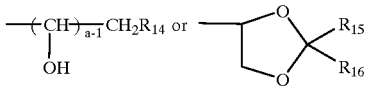

in which $R_{14}$ is a hydrogen atom or hydroxy group, a is an integer of 1 to 4, and $R_{15}$ and $R_{16}$ are each a hydrogen atom or a substituent.

Examples of the substituent represented by $R_{15}$ and $R_{16}$ include an alkyl group, an alkenyl group, an aryl group, a halogen atom, an alkoxy group, an aryloxy group, an alkylthio group, an arylthio group, an acyl group, an oxycarbonyl group, a carbamoyl group, a carboxy group (including its salt), a sulfo group (including its salt), and heterocyclic group. $R_{15}$ and $R_{16}$ may be linked together to form a ring comprised of carbon atom(s), nitrogen atom(s), oxygen atom(s) or sulfur atom(s). These groups may be further substituted. Examples of the substituent include an alkyl group, an alkenyl group, an aryl group, a halogen atom, cyano group, nitro group, hydroxy group, an alkoxy group, an aryloxy group an alkylthio group, an arylthio group, an acyloxy group, an amino group, an alkylamino group, a carbonamido group, a sulfonamido group, a ureido group, an acyl group, an oxycarbonyl group, a carbamoyl group, a sulfonyl group, a sulfamoyl group, a carboxy group (including its salt), a sulfo group (including its salt), and heterocyclic group. Of these, R15 and R16 are preferably a hydrogen atom, substituted or unsubstituted alkyl, alkenyl or aryl group; and more preferably a hydrogen atom or a substituted or unsubstituted alkyl group, and still more preferably a substituted or unsubstituted alkyl group, in which the substituent is an alkyl group, alkenyl group, an aryl group, a halogen atom, an alkoxy group, a carboxy group (including its salt), a sulfo group (including its salt), or a hydroxyamino group.

In formula (1-1), the compound is represented by a so-called enol form. In this case, a tautomer, keto-form is the same compound, and therefore, tautomers are within the range of the invention.

Exemplary examples of the compounds represented by formula (1-1) are shown below, but are not limited to these.

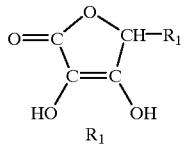

(1-1-1)

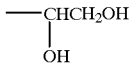

(1-1-2)

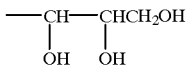

(1-1-3)

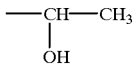

(1-1-4)

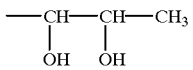

(1-1-5)

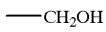

-continued
(1-1-6)
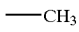
(1-1-7)
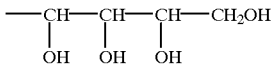
(1-1-8)
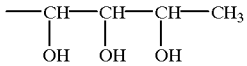
(1-1-9)
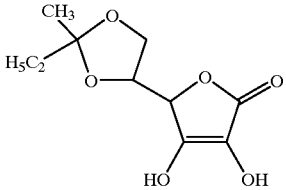
(1-1-10)
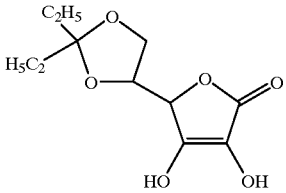
(1-1-11)
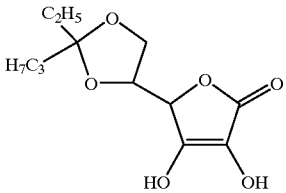
(1-1-12)
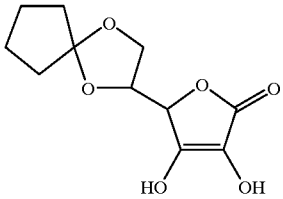
(1-1-13)
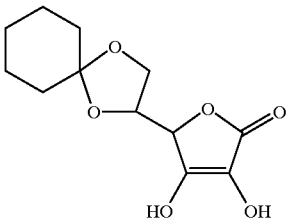
(1-1-14)
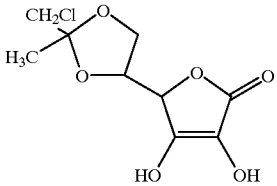
-continued
(1-1-15)
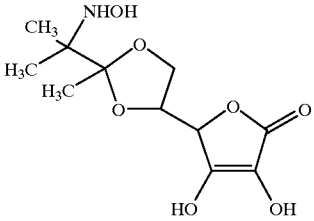
(1-1-16)
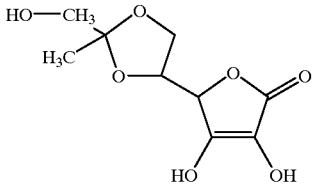
(1-1-17)
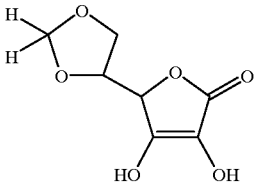
(1-1-18)
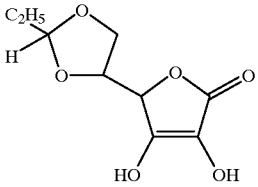
(1-1-19)
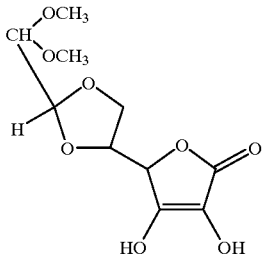
(1-1-20)
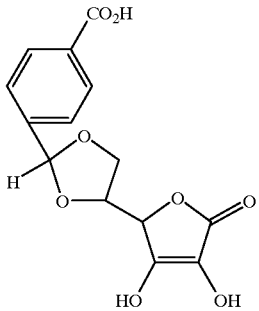
The reductons used in the invention may be in the form of an alkali salt, such as lithium salt, sodium salt, or potassium salt. Of these examples are preferred ascorbic acid or erythorbic acid (stereo-isomer) represented by formula 1-1-1 or their salts, and compound of 1-1-3. The amount of the reducton to be added into the developer or developing solution is not specifically limited, but is preferably 0.001 to 1 mol/l, and more preferably 0.01 to 0.5 mol/l.

The compound represented by formula (2) will be described. Examples of the compound represented by formula (29 are shown below, but are not limited to these. A catechin, which is included in the compounds represented by formula (2), includes (+)-catechin and (−)-catechin.

2-1

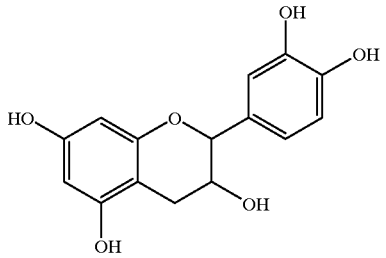

2-2

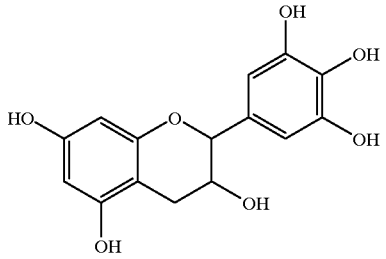

2-3

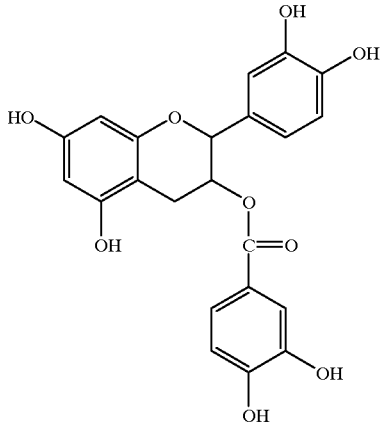

2-4

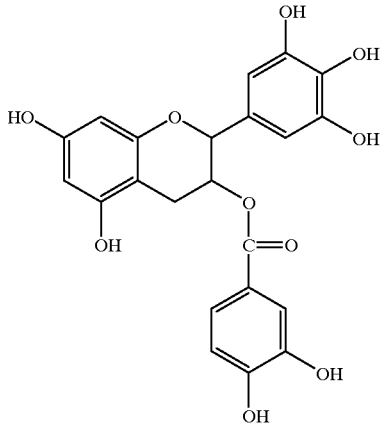

-continued 2-5

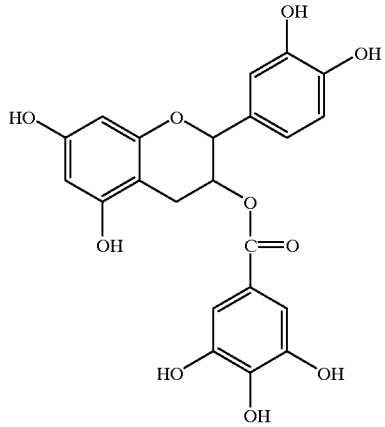

2-6

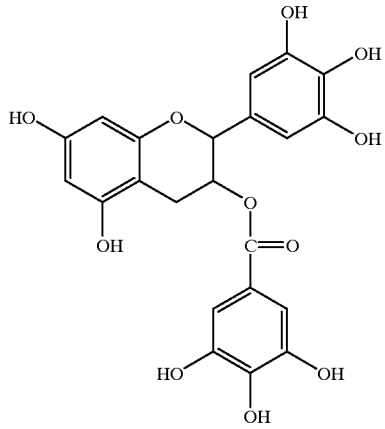

The amount of the above-described compound to be added into the developing solution is not specifically limited, but preferably 0.01 to 1.5 mol/l, and more preferably 0.05 to 1 mol/l. The compound represented by formula (2) may be used alone or in combination.

Requirement (1) will be further described:

$$L^{0.75} \times T = 50 \text{ to } 150 \qquad \text{requirement (1)}$$

wherein L is the transport length in the processor within a range of 0.5 to 0.8 m; and T is a total processing time of the processor. The processing time is selected so as to meet requirement (1). The value of $L^{0.75} \times T$ is 50 to 150, and preferably 50 to 100.

The roller used in the automatic processor, which exhibiting a contact angle with distilled water of 90° to 130°, is used in any of the developing rack, the fixing rack and the washing rack, and may be used in a cross-over rack between developing and fixing or a cross-over rack between fixing and washing. The roller is preferably used in the developing rack, enhancing the effects of the invention.

It is specifically preferred in terms of sludge adhesion and oxidation resistance that this roller is used for the roller located at the liquid-air interface. The roller may be used for all rollers used in the rack.

The roller has a surface-roughened resin layer mainly comprised of polypropylene provided on the periphery of a cylindrical reinforced core material and exhibiting a contact angle with distilled water of 90 to 130°. The resin layer preferably contains propylene in an amount of 95% or more by weight. The surface roughness of the peripheral resin layer on the roller is within a range of 0.1 to 0.6 μm of a center line-averaged roughness (which is denoted as Ra) and 1 to 7 μm of the maximum roughness in height (which is denoted as Rmax).

It was found by the inventor that stain adhesion to the roller surface is initialized by physical adhesion caused by the anchor effect between the resin and a silver compound. Based thereon, there was also found a resin, onto which the silver compound is not easily adhered, leading to development of a roller on which no stain adhesion occurs and whereby the amount of maintenance can be permanently reduced.

As is shown in FIG. 1, the roller used in the invention has a structure in which the periphery of a cylindrical pipe or a cylindrical core bar as a reinforced core material (2) is covered with a thermoplastic resin layer (1). The resin layer is preferably comprised of highly crystalline polypropylene, and preferably one which exhibits 0.94 or more tacticity, which can be determined by nuclear magnetic resonance (NMR). The tacticity (i.e., intramolecular stereoregularity) is referred to as a proportion accounted for by isotactic polypropylene among three kinds of stereoisomers, i.e., isotactic, syndiotactic and atactic polymers. The proportion of the isotactic polymer can be determined from difference in chemical shift between stereo-isomers in NMR spectrometry.

Figure 2:
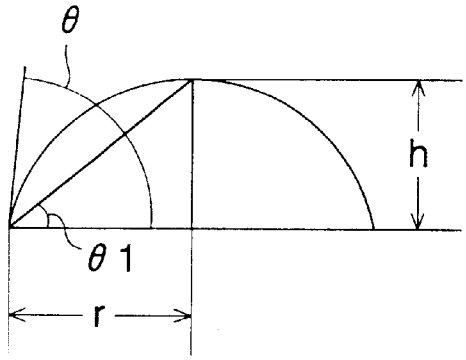
FIG. 2 illustrates a contact angle (θ) of a liquid drop.

The resin surface of the roller preferably exhibits 90 to 130° of a contact angle with water (i.e., contact angle between the resin and water). The contact angle can be measured using distilled water. FIG. 2 illustrates a contact angle (θ) of a liquid drop. The contact angle can be determined in the following manner. Thus, from a half of the base (r) a height of the drop, angle θ1 is determined using the following equation (1):

$$h/r=\tan\theta 1 \quad (1)$$

and the contact angle is determined based on the following definition (2):

$$2\times\theta 1=\text{contact angle } \theta \quad (2).$$

In cases when the contact angle is less than 90°, stain adhesion easily increases, and in cases when the contact angle is more than 130°, the roller surface easily becomes slippery, making it difficult to transport the photographic material films, and excessively enhancing water-repellence to processing solution such as a developing solution or fixing solution to deteriorate development uniformity.

The contact angle is essentially dependent of polypropylene. Exemplarily, the higher the crystallinity of the polypropylene, the higher the tacticity. As a roller used in the invention is preferably a contact angle with water within a range of 90 to 130°. Accordingly, the roller formed through extrusion needs to be subjected to rubbing-finishing such as cylinder rubbing or center-less rubbing or buff-finishing to roughen the resin surface, thereby enhancing wettability with liquid.

JP-A 6-83016 describs that when the use of highly water-repellent resin exhibiting a contact angle of more than 80° markedly reduces water receptivity of the roller surface, resulting in development unevenness (hereinafter, the term, JP-A means an unexamined and published Japanese Patent Application). However, highly crystalline polypropylene used in the invention exhibits superior water receptivity, in spite of its high contact angle, without producing development unevenness. On the other hand, conventionally used crystalline polypropylene exhibits 0.93 or less tacticity determined by NMR, easily causing stain adhesion on the roller surface and producing development unevenness due to its inferior water receptivity.

In the roller used in the invention, the surface roughness of the resin layer is preferably 0.1 to 0.6 μm of a center line-averaged roughness (Ra) and 1 to 7 μm of a maximum roughness in height (Rmax), and more preferably of 0.2 to 6 μm of Ra and 2 to 6 μm of Rmax. When the surface roughness is less than the preferred range described above, water receptivity is lowered, easily producing development unevenness. On the contrary, when the surface roughness is more than the preferred range, orange peel marks are easily produced due to protrusions on the roller surface.

The structure of the roller employed in the processor used in the invention (i.e., being the roller according to the invention) is shown in FIG. 1. To both edge portions of reinforced core material (2) covered with resin layer (1) are attached shaft ends (3), which are made of the same kind of resin as the resin layer. In this case, the shaft end is preferably adhered to the resin layer by high-frequency melting, thereby enhancing tightness and adhesion of both and preventing troubles deteriorating function of the roller, such as peeling, even when used while being immersed into the developing solution over a long period of time. Center shafts (4), which are fixed to the shaft ends (3), are held by a bearing.

Rollers prepared by the use of a resin layer of highly crystalline polypropylene exhibit superior water receptivity and developability, regardless of a high contact angle, thereby improving stain adhesion even when being immersed into developing or fixing solutions over a long period of time. The use of highly crystalline polypropylene results in superior rigidity and heat resistance, and its high surface hardness inhibits flaws produced on the roller surface, enhancing wear resistance.

The silver halide light sensitive photographic material used in the invention preferably has a silver coverage of 1.1 to 1.7 g, and more preferably 1.1 to 1.4 g per $m^2$ on one side of the photographic material.

The average flow velocity of the developing solution is defined as an average value of the flow velocities at the following three positions, in the center portions in the direction of the width and in the direction of transport of the developing rack:

1. A position at a depth of 3 cm from the surface of the developing solution;
2. A position at a height of 3 cm from the bottom of the developing tank; and
3. An intermediate position between positions 1. and 2.

The flow velocity is measured in such a manner that transport is stopped at the state the photographic material covers the entire path of the developing bath and after 1 min., the flow velocity at each of the three position described above are measured using a 3-dimension current meter (product by CHUO KOHSOKU Co. Ltd.). The flow velocity is defined as a combined value (V) determined according to the following equation:

$$V=(Vx^2+Vy^2+Vz^2)^{0.5}$$

Where Vx is the velocity in the x-direction, Vy is the velocity in the y-direction and Vz is the velocity in the z-direction. The average flow velocity is preferably 70 to 120 mm/sec., and more preferably 90 to 120 mm/sec.

Means for adjusting the flow velocity of the developing solution into the intended range is optional and not specifically limited. Thus, the flow velocity is controlled by the optional combination of the number, area or the position of the spouting hole of the developer circulation solution, the spouting amount or rate, the form of the developing rack and a rectification plate.

The developer refers to a developer replenishing solution, developer working solution, developer starting solution, and a concentrated kit solution or a solid kit composition prior dilution. The developer starting solution includes the developer replenishing solution added with a starter. The concentrated solution refers to a concentrated alkali solution, a concentrated acid solution, or a concentrated solution of a hardener such as glutar aldehyde, each of which is included into a hard bottle made of high density polyethylene or a flexible cubitainer and diluted with water at the time of using. The solid composition in the form of powder, granules, particles or a tablet. Specifically, the tablet-form composition is preferred in terms of storage stability.

The expression "developer being a single package means that all the developer component materials are included into a single package, in the form of powder, granules, a concentrated solution or a working solution.

The pH of the developer starting solution is preferably is 0.1 to 0.3 (and more preferably 0.2 to 0.3) lower than that of the developer replenishing solution. The expression "substantially free of dihydroxybenzene" means that the content of the dihydroxybenzene is 0.005 mol/l or less.

EXAMPLES

Embodiments of the present invention will be explained based on examples, but the present invention is not limited to these.

Example 1

A concentrated developer solution and a solid developer composition were each prepared according to the following formulas.

| Preparation of Concentrated Developer (for 2 lit. developing solution) | |
|---|---|
| Diethylenetriaminepentaacetic acid | 8.0 g |
| Sodium sulfite | 20.0 g |
| Sodium carbonate monohydrate | 52.0 g |
| Potassium carbonate | 55.0 g |
| Sodium erythorbate | 60.0 g |
| 4-Hydroxymethyl-4-methyl-1-phenyl-pyrazolidone | 13.0 g |
| Diethylene glycol | 50.0 g |
| N-acetyl-D,L-penicilamine | 0.5 g |
| 1-(3-Sulfophenyl)-5-mercaptotetrazole sodium salt | 1.0 g |
| Sodium 5-mercapto-(1H)-tetrazolylacetate | 0.15 g |
| Compound of formula (2) as shown in Table 1 | |
| Water to make | 1 lit. |

The concentrated developer solution was included into a hard bottle made of high density polyethylene.

Preparation of Solid Developer Composition

Solid developer composition containing reductones as a developing agent, for 100 lit. developing solution was prepared according to the following procedure. Preparation of granules (A1):

6000 g Sodium erythorbate, as reductones of formula (1) was pulverized up in a commercially available mill until reached an average particle size of 10 $\mu$m. To the resulting fine particles, were added sodium metabisulfite of 900 g, 1-Phenyl-3-pyrazolidone of 400 g, DTPA (i.e., diethylenetriaminepentaacetic acid)of 200 g, N-actyl-D,L-penicillamine of 10 g and sodium glutaraldehyde bissulfite of 500 g, a compound of formula (2) as shown in Table 1 and binder D-sorbit of 500 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off.

Preparation solid developing composition (A1):

Thus prepared granules (A1) was mixed with sodium 1-octanesulfonate of 140 g for 10 min. by making use of a mixer in a room controlled to be not higher than 25° C. and 40% RH. The resulting mixture was compression-tableted so as to have a filling amount of 10 g per tablet, by making use of a tableting machine that was modified model of Tough Press Collect 1527HU manufactured by Kikusui Mfg. Works, Inc. Thereby, developing composition tablets containing a reductone developing agent were prepared.

Granules (B1):

Potassium carbonate of 10,300 g and sodium bicarbonate of 100 g each were pulverized up in a commercially available mill until reached an average particle size of 10 $\mu$m. To the resulting fine particles, were added sodium sulfite of 700 g, KI of 7 g, 1-(3-sulfophenyl)-5-mercaptotetrazole sodium salt of 40 g, sodium 5-mercapto-(1H)-tetrazolylacetate of 8 g, bibder D-sorbit and mannitol of 1,500 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off to obtain granules (B1).

Preparation solid developing composition B1:

Thus prepared granules (B1) was mixed with sodium 1-octanesulfonate of 150 g for 10 min. by making use of a mixer in a room controlled to be not higher than 25° C. and 40% RH. The resulting mixture was compression-tableted so as to have a filling amount of 10 g per tablet, in a manner similar to the above by making use of a tableting machine. Thereby, alkaline developing composition tablets were prepared.

The prepared developing compositions in the form of a tablet A1 and B1, were packaged into a pillow bag containing aluminum for moisture-proof, in an amount of 5.0 liters of the developing solution, under atmosphere of 40% RH. Solid developer composition C was thus prepared.

Preparation of silver halide photographic material

Preparation of seed emulsion

Monodisperse seed emulsion Em-A was prepared according to the following procedure.

| Solution A1 | |
|---|---|
| $H_2O_2$-treated ossein gelatin | 11.3 g |
| Potassium bromide | 6.72 g |
| DF-1 | 1.2 ml |
| Water to make | 1.13 lit. |
| **Solution B1** | |
| Silver nitrate | 170 g |
| Water to make | 227.5 ml |
| **Solution C1** | |
| Ossein gelatin | 4.56 g |
| Potassium bromide | 119 g |
| Water to make | 227.5 ml |

-continued

| Solution D1 | |
|---|---|
| Aqueous ammonia (28%) | 66.6 ml |

Compound (DF-1)

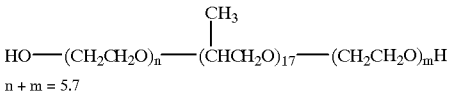

n + m = 5.7

To solution A1 with vigorously stirring were added solutions B1 and C1 by the double jet addition to form nucleus grains. After completing the addition, the temperature of the mixture was lowered to 20° C., the silver potential was adjusted to 40 mV, and solution Dl was added for 20 sec. and ripening was further conducted for 5 min.

Thereafter, 30 g of modified gelatin, in which the amino group of gelatin was substituted by phenylcarbamoyl group (substitution rate of 80%) was added and the pH was lowered to 3.0 to cause coagulation. The supernatant was decanted, 2,000 ml water was added thereto, the pH was raised to 6.0 and the mixture was dispersed. Thereafter, the pH was again lowered to 3.0 and similarly, decantation was conducted. Ossein gelatin of 23 g was further added thereto to redisperse the desalted seed emulsion. As a result of electronmicroscopic observation, the obtained seed emulsion was comprised of monodisperse silver bromide grains having an average grain size of 0.28 μm and exhibiting a distribution width of 20%.

Preparation of tabular grains

Using seed emulsion Em-A and the following solutions, a silver halide emulsion was prepared, which was mainly comprised of tabular grains.

| Solution E1 | |
|---|---|
| Ossein gelatin | 6.49 g |
| DF-1 | 1.2 ml |
| Seed emulsion Em-A | 0.62 mol equivalent |
| Solution F1 | |
| Ossein gelatin | 1.69 g |
| Potassium bromide | 113.0 g |
| Potassium iodide | 0.8 g |
| Water to make | 504 ml |
| Solution G1 | |
| Silver nitrate | 170 g |
| Water to make | 504 ml |

To solution E1 with vigorously stirring were added solutions F1 and G1 by the controlled double jet addition. The flow rate was controlled to 80% of the critical flow rate at which nucleus grains are newly produced, while the silver potential was maintained at −10 mV and at 65° C. using aqueous potassium bromide solution. After completing the addition, the pH was adjusted to 6.0 and the emulsion was desalted through flocculation using Demol solution (available from Kao-Atlas Corp.) and magnesium sulfate. Ossein gelation of 23 g was further added and the emulsion was redispersed. The emulsion exhibited a silver potential of 50 mV at 50° C. and a pH of 5.58. From electronmicroscopic observation of about 3,000 grains, it was proved that 80% of the total grain projected area was accounted for by hexagonal tabular grains exhibiting an average grain size (circular equivalent diameter) of 1.4 μm, an average thickness of 0.4 μm, an average aspect ratio of 3.5 and a degree of monodisperse of 15%.

Chemical ripening of tabular grain emulsion

To the prepared emulsion were added the following sensitizing dyes A and B in an amount of 400 mg and 4 mg per mol of silver, respectively, immediately before chemical sensitizers comprised of 5.2 ml of aqueous 1% $NH_4SCN$ solution, 0.78 ml of aqueous 0.2% $HAuCl_4$, 5.6 ml of aqueous 0.25% $Na_2S_2O_3$, and 3.5 ml of 0.4% triphenylphosphine selenide solution were added and chemical sensitization was conducted at 48° C.:

Sensitizing dye (A), anhydride of sodium 5,5'-dichloro-9-ethyl-3,3'-(3-sulfopropyl)-oxacarbocyanine Sensitizing dye (B), an anhydride of sodium 5,5'-di-(butoxycarbonyl)-1,1'-diethyl-3,3'-di-(4-sulfobutyl)-benzoimidazolocarbo-cyanine At 30 min. after starting chemical sensitization, AgI fine grains having an average grain size of 0.04 μm were added in an amount of 0.002 mol per mol of silver. Chemical ripening further continued, 300 mg/mol Ag of KBr and 1.4 g/mol Ag of 4-hydroxy-1,3,3a,7-tetrazaindene were added at the time an increase of the fog density reached 0.02, and the temperature was lowered to stop chemical ripening.

Preparation of Subbed Support

Dispersion of conductive particles P1

Tin(IV) chloride of 65 g was dissolved in 2000 cc water. The obtained aqueous solution was boiled to obtain a coprecipitate. The precipitate was taken out by decantation and washed a few times with distilled water. To water used for washing was added silver nitrate to confirm no reaction of chloride ions. The precipitate was dispersed in 1,000 cc distilled water, and then the total amount was adjusted to 2,000 cc; subsequently, 40 cc of aqueous 40% ammonia was added thereto and the dispersion was heated in a water bath to form $SnO_2$ sol. The sol dispersion was concentrated to 8% concentrate with blowing ammonia Thus prepared tin oxide sol was proved to have a specific volume resistance of $3.4\times10^4\Omega$ cm.

Preparation of support used for photographic material

Both surfaces of a biaxially stretched thermally fixed 175 μm PET film, available on the market, was subjected to corona discharging at 8 w/m$^2$·min. Onto one side of the film, as described in JP-A 59-19941, the subbing coating composition B-1 descried below was applied so as to form a dried layer thickness of 0.8 μm, which was then dried at 100° C. for 1 min. The resulting coating was designated Subbing Layer B-1. Onto the opposite surface, as described in JP-A 59-77439, the subbing coating composition B-2 described below was coated and dried at 110° C. for 1 min. to form a dried layer thickness of 0.8 μm. The resulting coating was designated Subbing Layer B-2.

| Subbing Coating Composition B-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| Compound A | 0.6 g |
| Hexamethylene-1,6-bis(ethyleneurea) | 0.8 g |
| Water to make | 1 liter |

| Subbing Coating Composition B-2 | |
|---|---|
| Latex liquid (solid portion of 30%) of a copolymer consisting of butyl acrylate (40 weight %) styrene (20 weight %) glycidyl acrylate (40 weight %) | 23 g |
| Conductive P1 dispersion | 415 g |
| Polyethylene glycol (MW = 600) | 0.00012 g |
| Water to make | 568 g |

Subsequently, the surfaces of Subbing Layers B-1 and B-2 were subjected to corona discharging with 8 w/m$^2$ minute. Onto the Subbing Layer A-1, the upper subbing layer coating composition B-3 described below was applied so as to form a dried layer thickness of 0.1 pm, which was designated Subbing Layer B-3

| Subbing Layer Coating Composition B-3 | |
|---|---|
| Gelatin | 10 g |
| Compound A | 0.4 g |
| Compound B | 0.1 g |
| Silica particles (av. size 3 $\mu$m) | 0.1 g |
| Water to make | 1 liter |

Compound A

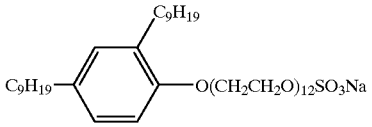

Compound B

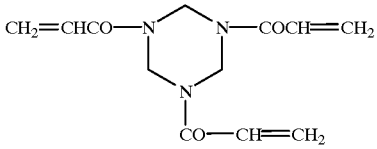

Preparation of Silver Halide Photographic Material

On both sides of the subbed PET base, a crossover-light shielding layer, emulsion layer and a protective layer were simultaneously coated in this order and dried to prepare a photographic material sample. The addition amount was adjusted as described below.

1st layer (crossover-light shielding layer)

| | |
|---|---|
| Solid fine-grain dispersion of dye (AH) | 50 mg/m$^2$ |
| Gelatin | 0.2 g/m$^2$ |
| Dextrin (MW = 1,000) | 0.05 g/m$^2$ |
| Dextrin (MW = 40,000) | 0.05 g/m$^2$ |
| Sodium dodecylbenzenesulfonate | 5 mg/m$^2$ |
| Sodium 2,4-dichloro-6-hydroxy-1,3,5-triazine | 5 mg/m$^2$ |
| Colloidal silica (having an average particle-size of 0.014 $\mu$m) | 10 mg/m$^2$ |

2nd layer (Emulsion layer)

The following additives were added to the emulsions chemically ripened in the above-mentioned manner.

| | |
|---|---|
| 1-Phenyl-5-mercaptotetrazole | 10 mg/m$^2$ |
| Trimethylol propane | 14 mg/m$^2$ |
| Compound (C) | 30 mg/m$^2$ |
| t-Butyl-catechol | 150 mg/m$^2$ |
| Polyvinyl pyrrolidone (having a molecular weight of 10,000) | 850 mg/m$^2$ |
| A styrene-maleic acid anhydride copolymer | 2.0 g/m$^2$ |
| Dextrin (MW = 1,000) | 1.2 g/m$^2$ |
| Dextrin (MW = 40,000) | 1.2 g/m$^2$ |
| Nitrophenyl-triphenyl-phosphonium Chloride | 50 mg/m$^2$ |
| Ammonium 1,3-dihydroxybenzene-4-sulfonate | 1.7 g/m$^2$ |
| 1,1-Dimethylol-1-brom-1-nitromethane | 6.2 mg/m$^2$ |
| n-$C_4H_9OCH_2CH(OH)CH_2N(CH_2COOH)_2$ | 700 mg/m$^2$ |
| Sodium 2-mercaptobenzimidazole-5-sulfonate | 30 mg/m$^2$ |
| Colloidal silica (Ludox AM produced by du Pont, av. size: 0.013 $\mu$m) | 28.5 g/m$^2$ |
| Latex (solid content) | 28.5 g/m$^2$ |
| Compound (D) | 150 g/m$^2$ |
| Compound (E) | 30 g/m$^2$ |
| Compound (F) | 30 g/m$^2$ |

3rd layer (Protective layer)

| | |
|---|---|
| Gelatin | 0.8 g/m$^2$ |
| A matting agent comprising polymethyl methacrylate (having an area average particle-size of 5.0 $\mu$m) | 21 mg/m$^2$ |
| A matting agent comprising polymethyl methacrylate (having an area average particle-size of 3.0 $\mu$m) | 28 mg/m$^2$ |
| Hardener $(CH_2{=}CHSO_2CH_2)_2O$ | 36 mg/m$^2$ |
| Sodium 2,4-dichloro-6-hydroxy-1,3,5-triazine | 10 mg/m$^2$ |
| Compound (G) | 15 mg/m$^2$ |
| Compound (H) | 5 mg/m$^2$ |
| Compound (I) | 30 mg/m$^2$ |
| Compound (J) | 10 mg/m$^2$ |

Compound (C)

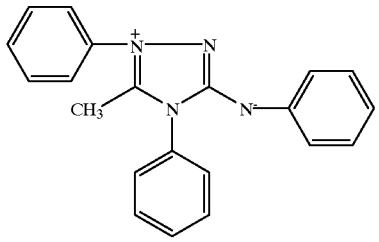

Compound (D)

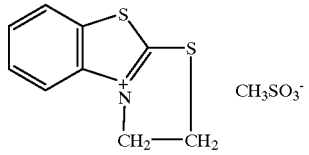

Compound (I)

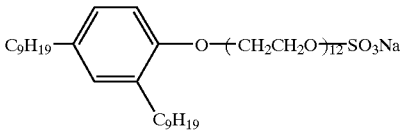

Compound (J)

-continued

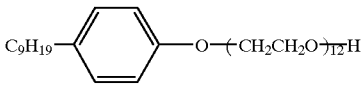

Compound (G)

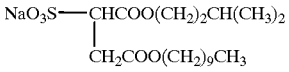

Compound (H)

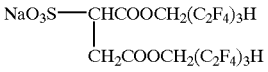

Latex (L)

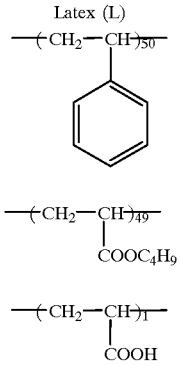

Solid particle dispersion of Dye (AH)

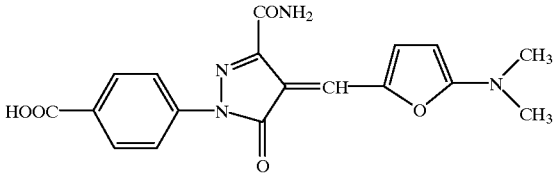

Compound (E)

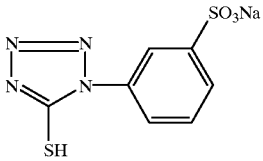

Compound (F)

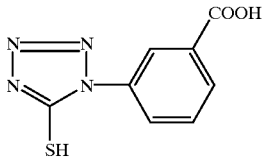

The thus prepared silver halide photographic material had a silver coverage per one sid of 1.3 g/m$^2$ and a gelatin coating amount per one side of 2.2 g/m$^2$. The photographic material was allowed to stand at 40° C. and 50% RH for 24 hrs and thereafter was evaluated.

A solid fixing composition, which was employed as 100 liters of a fixing solution, was prepared in the following manner.

Granules (C):

Ammonium thiosulfate/sodium thiosulfate (90/10 by weight) of 15,000 g was pulverized up in a commercially available mill so as to have an average particle size of 10 $\mu$m. To the resulting fine powder, were added sodium sulfite of 500 g, $Na_2S_2O_5$ of 750 g and binder Pineflow of 1,300 g and the mixture was mixed in the mill for 3 min. In stirring granulator commercially available, the resulting mixture was granulated by adding 50 ml of water. The resulting granules were dried up at 40° C. in a fluidized bed drier so that the moisture content of the granules was almost completely removed off.

Granules (D):

Boric acid of 400 g, aluminum sulfate octahydrate of 1,200 g, cinnamic acid of 1200 g and tartaric acid of 300 g were pulverized up in a commercially available mill so as to have an average particle size of 10 $\mu$m. To the resulting fine particles was added D-mannit of 250 g, D-sorbit of 120 g and PEG #4000 of 160 g and the resulting mixture was granulated by adding 30 ml of water. The resulting granules were dried up at 40° C. in a fluidized bed drier so that the moisture content of the granules was almost completely removed off.

To the thus prepared granules (C) were added β-alanine of 3000 g, sodium acetate of 4330 g and sodium 1-octanesulfonate in an amount so as to be 1.5% of the total weight, to granule (D) were added sodium metabisulfite of 750 g and sodium 1-octanesulfonate in an amount so as to be 1.0% of the total weight, and each mixed for 10 min. by making use of a mixer in a room controlled to be not higher than 25° C. and 40% RH. Each of the mixture was compression-tableted so as to have a filling amount of 10.2 g per tablet (C) and 11.2 g per tablet (D), by making use of a tableting machine that was modified model of Tough Press Collect 1527HU manufactured by Kikusui Mfg. Works, Inc. Thus prepared fixing compositions C and D in the form of a tablet were each packaged into a pillow bag containing aluminum for moisture-proof, in an amount for 4.5 liters of the fixing solution.

Dissolving the prepared developer in water, developing solutions of concentrated developer solution A (single pack) and concentrated developer solution B (two pack) were each adjusted to a pH of 10.10 with acetic acid or KOH; developing solution of solid developer composition C containing reductones as a developing agent was adjusted to a pH of 10.20. The fixing solution was adjusted to a pH of 4.60. These were used as a developer or fixer replenishing solution.

| Starter (for 1 lit. of developing solution) | |
|---|---|
| KBr | 4.5 g |
| $HO(CH_2)_2S(CH_2)_2S(CH_2)_2OH$ | 0.05 g |
| Acetic acid (90%) | 7.5 g |
| Diethylene glycol | 40 g |
| Water to make | 70 ml |

Processing was carried out at a developing temperature of 35° C., a fixing temperature of 35° C. and a drying air temperature of 55° C. in a total processing time (dry to dry) of 90 sec.

Sensitometric Evaluation

The photographic material sample was laminated with intensifying screens KO-250 (available from Konica Corp.) using a cassette and exposed through an aluminum wedge to X-rays at bulb voltage of 80 kVp and a bulb current of 100 mA for 0.05 sec. The exposed photographic material was processed according to the conditions described above. Sensitivity was represented by a relative value of reciprocal of exposure necessary to give a density of fog plus 1.0.

In addition to the sensitometric evaluation (sensitivity), uniformity in development and sludge or crystal adhesion were also evaluated at the time of start or after running process over 3 or 6 months, based on the following criteria.

Evaluation of Development uniformity

Photographic material samples were each cut to a size of 20×24 inch, subjected to exposure giving a density of 1.0 and processed. Processed samples were visually evaluated with respect to evenness in development, based on the following criteria:

5; no unevenness in density was observed,

4; very slight unevenness in density was partially observed at a level of no problem in practical use, 3; slight uneven density was observed at an acceptable level in practical use, 2; marked unevenness in density was partially observed at an acceptable level in practical use, and 1; marked unevenness in density was entirely observed.

Evaluation of sludge of crystal adhesion

After continuous processing was run over 6 months, the vicinity of the developing tank and the developing rack were observed and visually evaluated with respect to levels of crystallization and sludge adhesion, based on the following criteria:

4; neither brown crystal nor sludge adhered to the rack or roller was observed,

3; adhered crystals, which were readily soluble in water, and slight adhesion of sludge were observed, but acceptable level in practical use, 2; crystals which were not easily soluble in water and sludge was evidently observed, and 1; blocks of adhered crystals, which were insoluble in water and sludge adhered onto processed films were observed and unacceptable level in practical use.

Photographic material samples were prepared varying the silver coverage per one side, as shown in Table 1.

Solid developer composition and solid fixed composition were each packaged into a pillow bag containing aluminum for moisture-proof, in an amount of 5.0 liters of the developing solution or fixing solution. Using a chemical mixer only used for dissolving tablets, TCX-201 (available from Konica Corp.), in which the internal chemical mixer was modified for 5 lit. dissolution, the solid developer composition and the solid fixer composition were each dissolved in water and the pH thereof was adjusted similarly to Example 1. The thus prepared developing and fixing solutions were each transferred, as a replenishing solution, to an auxiliary tank supplying the replenishing solution.

The replenishing solutions were each supplied to the developing bath or fixing tank of automatic processor SRX-101 (available from Konica Corp.) to filled the tank. The developer replenishing solution was added with the starter described below to use as a developer starting solution. In this case, the pH of the developer starting solution was adjusted with acetic acid so that the difference in pH between the developer starting solution and developer replenishing solution exhibited the value as shown in Table 1, and thereafter processing started.

| Starter (for 1 lit. of developing solution) | |
|---|---|
| KBr | 4.5 g |
| $HO(CH_2)_2S(CH_2)_2S(CH_2)_2OH$ | 0.05 g |
| Acetic acid (90%) | 7.5 g |
| Diethylene glycol | 40 g |
| Water to make | 70 ml |

Processing was run using automatic processor SRX-101 (available from Konica Corp.), which was modified so as to have the ratio of the temperature-controlling tank to the processing tank, as shown in Table 1. In this case, the volume of the temperature-controlling tank was increased or decreased according to this ratio. Further, the processor was modified so that the developing solution in the developing tank exhibited the average flow velocity as shown in Table 1. Furthermore, the processor was modified so that the transport length (L) and the value of $L^{0.75}$ x processing time (T) were as shown in Table 1.

In the transport roller used in the developing rack, materials exhibiting different contact angles were employed as shown in Table 1.

Using automatic processor SRX-101, as modified above, and each of the exposed photographic material samples, in an amount of 10 sheets of 10×12 inch of each sample per day, continuous processing was run over a long period of time, in which the developer was replenished at a rate shown in Table 1 and the fixer was replenished at a rate of 150 $ml/m^2$.

Evaluation results are shown in Table 1.

TABLE 1

| | | Developer | | | |
|---|---|---|---|---|---|
| Evaluation No. | Silver Coverage | Compound (G/l) | Developer | Rpl. Rate*2 | pH Diff.*1 |
| 1 | 1.3 | 2–7 (10) | S*3 | 100 | −0.2 |
| 2 | 1.3 | 2–7 (10) | S | 100 | −0.2 |
| 2.1 | 1.3 | 2–7 (10) | S | 100 | −0.2 |
| 2.2 | 1.3 | 2–7 (10) | S | 100 | −0.2 |
| 2.3 | 1.3 | 2–7 (10) | S | 100 | −0.2 |
| 2.3 | 1.3 | 2–7 (10) | S | 100 | −0.2 |
| 2.4 | 1.3 | 2–7 (10) | S | 100 | −0.2 |
| 2.4 | 1.3 | 2–7 (10) | S | 100 | −0.2 |
| 2.5 | 1.3 | 2–7 (1) | S | 100 | −0.2 |
| 3 | 2.0 | — | — | 100 | −0.05 |
| 4 | 2.0 | 2–1 (10) | L*4 | 100 | −0.05 |
| 5 | 2.0 | 2–2 (10) | S | 100 | −0.2 |
| 6 | 1.3 | 2–3 (10) | L | 100 | −0.2 |
| 7 | 2.0 | 2–4 (10) | S | 100 | −0.2 |

TABLE 1-continued

| | | | | | |
|---|---|---|---|---|---|
| 8 | 1.3 | 2–5 (10) | S | 200 | −0.2 |
| 9 | 2.0 | — | — | 100 | −0.05 |
| 10 | 1.0 | 2–7 (10) | L | 200 | −0.4 |

| | Processor | | | | | | |
|---|---|---|---|---|---|---|---|
| | | | Transport Roller | | | | |
| Evaluation No. | Ratio*5 | Velocity*6 | Kind | Ra | θ | L (m) | $L^{0.75} \times T$ |
| 1 | 0.8 | 100 | PP*7 | 0.3 | 120 | 0.7 | 75 |
| 2 | 0.8 | 100 | PP | 0.3 | 120 | 0.7 | 130 |
| 2.1 | 1 | 100 | PP | 0.3 | 120 | 0.7 | 75 |
| 2.2 | 0.4 | 100 | PP | 0.3 | 120 | 0.7 | 75 |
| 2.3 | 1.3 | 100 | PP | 0.3 | 120 | 0.7 | 75 |
| 2.3 | 0.2 | 100 | PP | 0.3 | 120 | 0.7 | 75 |
| 2.4 | 0.8 | 100 | PP | 0.3 | 120 | 0.7 | 160 |
| 2.4 | 0.8 | 100 | PP | 0.3 | 120 | 0.7 | 40 |
| 2.5 | 0.8 | 100 | PP | 0.3 | 120 | 0.7 | 75 |
| 3 | 0.8 | 60 | PH*8 | 0.8 | 70 | 0.7 | 75 |
| 4 | 0.8 | 60 | PH | 0.8 | 70 | 0.7 | 75 |
| 5 | 0.8 | 60 | PH | 0.8 | 70 | 0.7 | 75 |
| 6 | 0.8 | 100 | PH | 0.8 | 70 | 0.7 | 75 |
| 7 | 0.8 | 60 | PP | 0.3 | 120 | 0.7 | 75 |
| 8 | 0.8 | 100 | PP | 0.3 | 120 | 0.7 | 75 |
| 9 | 0.2 | 60 | PH | 0.8 | 70 | 0.7 | 75 |
| 10 | 0.8 | 130 | PH | 0.8 | 70 | 0.7 | 75 |

| | Sensitivity*9 | | | Development Uniformity | | Sludge Adhesion | | |
|---|---|---|---|---|---|---|---|---|
| Evaluation No. | Fresh | 3 months | 6 months | Fresh | 6 months | Fresh | 6 months | Remark |
| 1 | 100 | 100 | 100 | 5 | 5 | 4 | 4 | Inv. |
| 2 | 115 | 115 | 113 | 5 | 5 | 4 | 4 | Inv. |
| 2.1 | 100 | 100 | 100 | 5 | 5 | 4 | 4 | Inv. |
| 2.2 | 100 | 96 | 92 | 5 | 4 | 4 | 3 | Inv. |
| 2.3 | 100 | 100 | 95 | 5 | 4 | 4 | 2 | Comp. |
| 2.3 | 100 | 85 | 60 | 5 | 1 | 4 | 1 | Comp. |
| 2.4 | 115 | 112 | 108 | 4 | 2 | 4 | 2 | Comp. |
| 2.4 | 80 | 60 | 45 | 3 | 1 | 4 | 1 | Comp. |
| 2.5 | 100 | 97 | 90 | 5 | 3 | 4 | 3 | Inv. |
| 3 | 105 | 95 | 87 | 4 | 2 | 4 | 3 | Inv. |
| 4 | 105 | 99 | 93 | 4 | 3 | 4 | 3 | Inv. |
| 5 | 105 | 102 | 97 | 4 | 3 | 4 | 3 | Inv. |
| 6 | 100 | 99 | 98 | 5 | 4 | 4 | 3 | Inv. |
| 7 | 105 | 103 | 100 | 5 | 3 | 4 | 3 | Inv. |
| 8 | 100 | 100 | 100 | 5 | 5 | 4 | 4 | Inv. |
| 9 | 100 | 70 | 50 | 2 | 1 | 4 | 1 | Comp. |
| 10 | 115 | 100 | 85 | 4 | 3 | 4 | 1 | Comp. |

*1Difference in pH between developer starting and replenishing solutions, indicating values of the pH of the starting solution minus that of the replenishing solution
*2Replenishing rate (ml/m$^2$)
*3Solid developer composition C
*4Liquid developer A
*5The ratio by volume of the temperature-controlling tank to the processing tank
*6Average flow velocity (mm/sec)
*7Polypropylene resin
*8Phenol resin
*9Relative value, based on the sensitivity in fresh solution of Evaluation No. 1 being 100.

As can be seen from Table 1, it was proved that the use of reductones, as a developing agent, in the automatic processor according to the invention led to improvements in stability of sensitivity over a long period of time, uniformity in development and sludge and crystal adhesion. These effects were marked even when processed at a low replenishing rate.

What is claimed is:

1. A method for processing a silver halide light sensitive photographic material comprising on a support a silver halide emulsion layer by the use of an automatic processor, the method comprising the steps of:

developing an exposed photographic material with a developing solution, fixing the developed photographic material with a fixing solution, and washing the photographic material, wherein a developing bath of the processor comprises a processing tank and a temperature-controlling tank and a ratio by volume of the temperature-controlling tank to the processing tank being 0.4 to 1.0; said developing solution containing a reducton represented by the following formula (1); and the photographic material being processed according to the following requirement [1]:

formula (1)

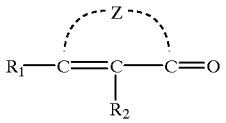

wherein $R_1$ and $R_2$ are each —OM, a mercapto group, an amino group, an acylamino group, an alkylsulfonylamino group, an arylsulfonylamino group, an alkoxycarbonyl group or an alkylthio group, in which M is a hydrogen atom or an alkali metal; Z is an atomic group necessary to complete a 5- or 6-membered ring; and $$L^{0.75} \times T = 50 \text{ to } 150 \qquad \text{requirement [1]}$$

wherein L is a transport length in the processor within a range of 0.5 to 0.8 m; and T is a total processing time of the processor.

2. The processing method of claim 1, wherein the processor comprises a developing rack having a cylindrical transport roller exhibiting a contact angle with distilled water of 90 to 130°.

3. The processing method of claim 1, wherein the processor comprises a developing rack having a cylindrical transport roller having a resin surface layer containing polypropylene.

4. The processing method of claim 3, wherein said resin layer exhibits a surface roughness of 0.1 to 0.6 $\mu$m in terms of a center line-averaged roughness (Ra) and a maximum roughness in height (Rmax) of 1 to 7 $\mu$m.

5. The processing method of claim 1, wherein the photographic material has a silver coverage of 1.1 to 1.7 g per $m^2$ of one side of the photographic material.

6. The processing method of claim 1, wherein the average flow velocity of the developing solution at the time of developing is 70 to 120 mm/sec.

7. The processing method of claim 2, wherein said cylindrical transport roller has a resin surface layer containing polypropylene.

8. The processing method of claim 1, wherein the photographic material has a silver coverage of 1.1 to 1.7 g per $m^2$ of one side of the photographic material, and the average flow velocity of the developing solution at the time of developing being 70 to 120 mm/sec.

9. The processing method of claim 1, wherein the developing solution contains a compound represented by the following formula (2):

formula (2)

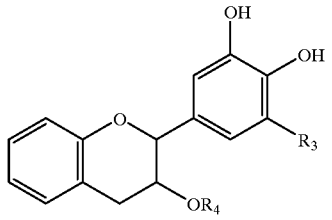

wherein $R_3$ is a hydrogen atom or a hydroxy group; $R_4$ is a hydrogen atom or a group represented by the following formula (3):

formula (3)

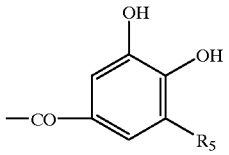

wherein $R_5$ is a hydrogen atom or a hydroxy group.

10. The processing method of claim 1, wherein the pH of the developing solution at the start of developing is 0.1 to 0.3 lower than that of a developer replenishing solution.

11. The processing method of claim 1, wherein the developing solution is substantially free of a dihydroxybenzene compound.

12. The processing method of claim 1, wherein a developer replenishing rate is 70 to 150 ml/$m^2$.

13. The processing method of claim 1, wherein said reductone represented by formula (1) is contained in an amount of 0.001 to 1 mol per liter of the developing solution.

14. The processing method of claim 1, wherein said reductone is a compound represented by formula (1-1):

formula (1-1)

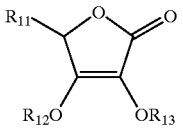

wherein $R_{12}$ and $R_{13}$ are each a hydrogen atom or an alkali metal; and $R_{11}$ is

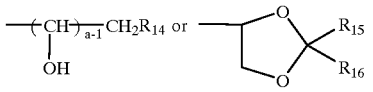

wherein $R_{14}$ is a hydrogen atom or hydroxy group, a is an integer of 1 to 4, and $R_{15}$ and $R_{16}$ are each a hydrogen atom or a substituent.

15. The processing method of claim 1, wherein said requirement is $L^{0.75} \times T = 50$ to 100.

16. The processing method of claim 1, wherein the photographic material is a black-and-white photographic material.

17. The processing method of claim 1, wherein the processor comprises a developing rack having a cylindrical transport roller having a polypropylene surface layer exhibiting-a contact angle with distilled water of 90 to 130°; the photographic material having a silver coverage of 1.1 to 1.7 g per $m^2$ of one side of the photographic material; and the average flow velocity of the developing solution at the time of developing being 70 to 120 mm/sec.

18. The processing method of claim 1, wherein said reductone is a compound represented by formula (1-1) and contained in an amount of 0.001 to 1 mol/l:

formula (1-1)

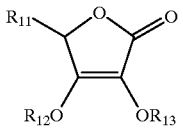

wherein $R_{12}$ and $R_{13}$ are each a hydrogen atom or an alkali metal; and $R_{11}$ is

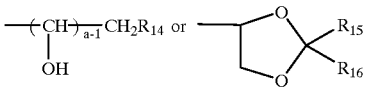

in which $R_{14}$ is a hydrogen atom or hydroxy group, a is an integer of 1 to 4, and $R_{15}$ and $R_{16}$ are each a hydrogen atom or a substituent; and said requirement being $L^{0.75} \times T = 50$ to 100.

19. The processing method of claim 18, wherein the pH of the developing solution at the start of developing is 0.1 to 0.3 lower than that of a developer replenishing solution.

20. The processing method of claim 19, wherein the processor comprises a developing rack having a cylindrical transport roller having a polypropylene surface layer exhibiting a contact angle with distilled water of 90 to 130°; the photographic material having a silver coverage of 1.1 to 1.4 g per $m^2$ of one side of the photographic material; the average flow velocity of the developing solution at the time of developing being 70 to 120 mm/sec; and the developer replenishing rate being 70 to 150 $ml/m^2$.

* * * * *

UNITED STATES PATENT AND TRADEMARK OFFICE

CERTIFICATE OF CORRECTION

PATENT NO. : 6,218,092 B1
DATED : April 17, 2001
INVENTOR(S) : Kazuya Tsukada

It is certified that error appears in the above-identified patent and that said Letters Patent is hereby corrected as shown below:

Column 19,
Line 20, after "0.1" delete "pm," and insert therefor -- $\mu$m --

Column 28,
Line 58, after "layer" delete "exhibiting-a" and insert therefor -- exhibiting a --

Signed and Sealed this

Twenty-sixth Day of October, 2004

JON W. DUDAS
*Director of the United States Patent and Trademark Office*